US009763003B2

(12) United States Patent
Usher et al.

(10) Patent No.: US 9,763,003 B2
(45) Date of Patent: Sep. 12, 2017

(54) AUTOMOTIVE CONSTANT SIGNAL-TO-NOISE RATIO SYSTEM FOR ENHANCED SITUATION AWARENESS

(75) Inventors: John Usher, Devon (GB); Steven W. Goldstein, Delray Beach, FL (US); John G. Casall, Christiansburg, VA (US)

(73) Assignee: Staten Techiya, LLC, Delray Beach, FL (US)

( * ) Notice: Subject to any disclaimer, the term of this patent is extended or adjusted under 35 U.S.C. 154(b) by 595 days.

(21) Appl. No.: 13/978,983

(22) PCT Filed: Jan. 12, 2012

(86) PCT No.: PCT/US2012/021074
§ 371 (c)(1),
(2), (4) Date: Oct. 30, 2013

(87) PCT Pub. No.: WO2012/097148
PCT Pub. Date: Jul. 19, 2012

(65) Prior Publication Data

US 2015/0036832 A1 Feb. 5, 2015

Related U.S. Application Data

(60) Provisional application No. 61/432,014, filed on Jan. 12, 2011.

(51) Int. Cl.
*H04R 29/00* (2006.01)
*H04R 3/00* (2006.01)

(52) U.S. Cl.
CPC ..... *H04R 3/005* (2013.01); *H04R 29/00* (2013.01); *H04R 2420/01* (2013.01); *H04R 2499/13* (2013.01)

(58) Field of Classification Search
CPC .. H04R 3/005; H04R 2499/13; H04R 1/1083; H04R 29/00; H04R 3/04; H04R 1/406;
(Continued)

(56) References Cited

U.S. PATENT DOCUMENTS 5,081,682 A 1/1992 Kato et al.
6,360,187 B1 3/2002 Hermann
(Continued)

OTHER PUBLICATIONS

International Search Report for International Application No. PCT/US2012/021074, dated Jul. 13, 2012.
(Continued)

*Primary Examiner* — Akelaw Teshale

(57) ABSTRACT

Audio systems for a vehicle and methods for increasing auditory situation awareness in a vehicle are provided. An audio system includes at least one ambient microphone disposed on the vehicle, a processor and at least one loudspeaker. The at least one ambient microphone is configured to capture ambient sound external to the vehicle and to produce an ambient sound signal. The processor is configured to receive the ambient sound signal and an audio content signal, and to mix the ambient sound signal with the audio content signal to generate a mixed output signal. The at least one loudspeaker is configured to reproduce the mixed output signal in the vehicle cabin.

19 Claims, 4 Drawing Sheets

(58) Field of Classification Search
CPC ..... H04R 1/08; H04R 2201/107; H04R 3/00; H04R 5/02; H04R 5/04; H04R 1/00; H04R 1/342
USPC ..... 381/56, 86, 71.3, 302, 365, 389
See application file for complete search history.

(56) References Cited

U.S. PATENT DOCUMENTS

| | | | | |
|---|---|---|---|---|
| 2003/0076968 | A1 | 4/2003 | Rast | |
| 2006/0253282 | A1 | 11/2006 | Schmidt et al. | |
| 2008/0137873 | A1* | 6/2008 | Goldstein | H04R 1/1016 381/57 |
| 2009/0010442 | A1* | 1/2009 | Usher | H03G 3/32 381/57 |
| 2009/0010444 | A1* | 1/2009 | Goldstein | H04R 3/00 381/66 |
| 2009/0016542 | A1* | 1/2009 | Goldstein | H04R 3/005 381/57 |
| 2009/0146799 | A1* | 6/2009 | Goldstein | B60Q 5/00 340/463 |
| 2010/0033313 | A1* | 2/2010 | Keady | G08G 1/0965 340/438 |
| 2013/0064392 | A1* | 3/2013 | Sugiyama | G10L 21/0208 381/94.1 |

OTHER PUBLICATIONS

Written Opinion for International Application No. PCT/US2012/021074, dated Jul. 13, 2012.

Wickens, "Situation Awareness: Review of Mica Endsley's 1995 Articles on Situation Awareness Theory and Measurement", Human Factors, vol. 50, No. 3, Jun. 2008, pp. 397-403.

* cited by examiner

100

104
102
108
107
112
118
110
106
126
114
128
116
120
124
122

AUTOMOTIVE CONSTANT SIGNAL-TO-NOISE RATIO SYSTEM FOR ENHANCED SITUATION AWARENESS

CROSS REFERENCE TO RELATED APPLICATIONS

This application claims priority to PCT International Application No. PCT/US2012/021074 filed Jan. 12, 2012, entitled "AUTOMOTIVE CONSTANT SIGNAL-TO-NOISE RATIO SYSTEM FOR ENHANCED SITUATION AWARENESS" and claims the benefit of U.S. Provisional Application No. 61/432,014 entitled "AUTOMOTIVE CONSTANT SIGNAL-TO-NOISE RATIO SYSTEM FOR ENHANCED SITUATION AWARENESS" filed on Jan. 12, 2011, the contents of which are incorporated herein by reference.

FIELD OF THE INVENTION

The present invention relates to a device that monitors sound directed to a vehicle cabin, and more particularly, though not exclusively, to an audio system and method that monitors signal-to-noise ratios in a vehicle cabin and reproduces ambient sound within the vehicle cabin to maintain sonic situation awareness.

BACKGROUND OF THE INVENTION

Individuals using audio systems in vehicles generally do so for music enjoyment and/or for voice communication. The vehicle operator is typically immersed in the audio experience when using such devices. The acoustic signals produced from these devices may contend with background noise from the external vehicle environment (e.g., road, engine, wind and traffic noise), as well as noise from the internal vehicle environment (e.g., heating and ventilation noise) in order to be audible. As the background noise levels change, the operator may need to adjust the volume, in order to listen to their music over the background noise. Alternatively, the level of reproduced audio may be automatically increased, for example, by audio systems that increase the audio level as the vehicle velocity increases (i.e., to compensate for the rise in noise level from road, engine, and aerodynamic noise). One example of such an automatic gain control system is described in U.S. Pat. No. 5,081,682.

SUMMARY OF THE INVENTION

Aspects of the present invention relate to audio systems for a vehicle. The audio system includes at least one ambient microphone, a processor and at least one loudspeaker. The at least one ambient microphone is disposed on the vehicle, and configured to capture ambient sound external to the vehicle and to produce an ambient sound signal. The processor is configured to receive the ambient sound signal and an audio content signal, and to mix the ambient sound signal with the audio content signal to generate a mixed output signal. The at least one loudspeaker is configured to reproduce the mixed output signal in the vehicle cabin.

Aspects of the present invention also relate to methods for increasing auditory situation awareness in a vehicle. The method includes receiving an ambient sound signal from at least one ambient microphone disposed on the vehicle for capturing ambient sound external to the vehicle; receiving an audio content signal; determining a desired signal-to-noise ratio (SNR) in a vehicle cabin of the vehicle; determining an actual SNR in the vehicle cabin; determining an SNR error between the desired SNR and the actual SNR; mixing the audio content signal with the ambient sound signal to generate a mixed output signal responsive to the SNR error; and reproducing the mixed output signal in the vehicle cabin, to increase the auditory situation awareness to the ambient sound external to the vehicle.

Aspects of the present invention also relate to methods for providing a transient detection alert to a transient acoustic event external to a vehicle. The method includes receiving an ambient sound pressure level of an ambient sound signal from at least one ambient microphone disposed on the vehicle for capturing ambient sound external to the vehicle; and receiving a current cabin signal-to-noise-ratio (SNR) estimate and a previous cabin SNR estimate when the ambient sound pressure level is greater than a predetermined threshold. Each of the current cabin SNR estimate and the previous cabin SNR estimate represents a ratio between an internal sound level in a vehicle cabin of the vehicle and a level of the ambient sound signal. The method also includes determining a SNR change between the current cabin SNR estimate and the previous cabin SNR estimate; and issuing the transient detection alert within the vehicle cabin when the SNR change is greater than a predetermined SNR change threshold.

BRIEF DESCRIPTION OF THE DRAWINGS

The invention may be understood from the following detailed description when read in connection with the accompanying drawing. It is emphasized, according to common practice, that various features of the drawings may not be drawn to scale. On the contrary, the dimensions of the various features may be arbitrarily expanded or reduced for clarity. Moreover, in the drawing, common numerical references are used to represent like features. Included in the drawing are the following figures.

DETAILED DESCRIPTION OF THE INVENTION

Figure 1:
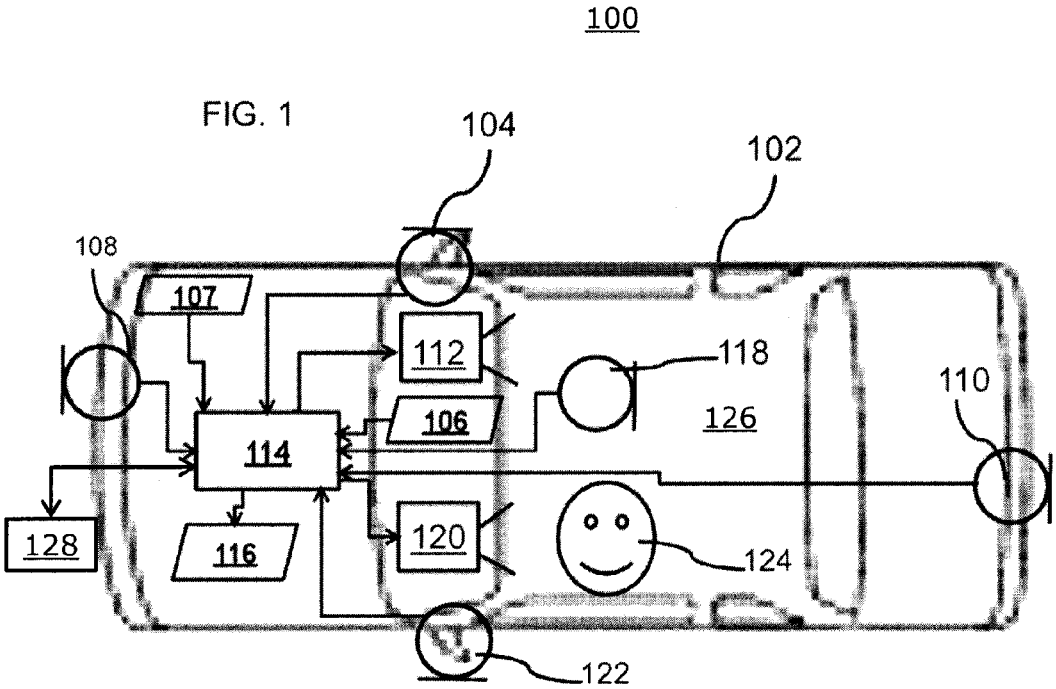
FIG. 1 is a functional block diagram of an exemplary system in a vehicle for enhancing auditory situation awareness, according to an embodiment of the present invention.

As the sound level of audio reproduced in the vehicle cabin increases, the vehicle operator may become sonically disassociated with his/her ambient environment, thereby increasing the danger of accidents from collisions with oncoming vehicles. A need therefore exists for improving the sound delivery experience of vehicle audio systems and enhancing situation awareness of the vehicle operator.

Music reproduction levels in vehicles and ambient sound levels are typically antagonistic. For example, vehicle operators typically play vehicle audio devices louder to hear over the traffic and general urban noise. The same applies to voice communication.

Rising population densities have also increased the sound levels on roads. According to a recent study, 40% of the European community is continuously exposed to transportation noise of 55 dBA, and 20% are exposed to greater than 65 dBA of transportation noise. The level of 65 dBA is considered by the World Health Organization to be intrusive or annoying, and as mentioned above, can lead to users of personal audio devices increasing the reproduction level of audio devices (and devices for voice communication) to compensate for ambient noise.

Automotive vehicle operators are often auditorially removed from their external ambient environment external to the vehicle. For example, high sound isolation from the external environment may be provided by cabin structural insulation, close-fitting window seals and thick or double-paned glass. External acoustic signals (i.e., ambient sound cues), such as oncoming emergency (and non-emergency) vehicle warning sounds; vocal messages from pedestrians; and sounds generated by the operator's own vehicle may often not be heard by the vehicle operator.

To summarize, the reduced "situation awareness" of the vehicle operator may be a consequence of multiple factors. One factor includes acoustic isolation of the vehicle cabin (e.g., from the vehicle windows and structural insulation). Another factor includes auditory masking of the ambient sound cues, so that the ambient sound cues may not be heard by the vehicle operator. The auditory masking may include energetic masking due to engine and road noise; broad spectrum masking due to external wind noise as well as heating and ventilation noise; and, especially, loud music reproduction levels or speech audio reproduction levels in the vehicle cabin. The masking effect may be further compounded with telephone communication, where the vehicles operator's attention may be further distracted by the conversation. Telephone communication, thus, may introduce an additional cognitive load that may further reduce the vehicle operator's situation awareness of the vehicle surroundings.

The reduction of the situation awareness of the vehicle operator may lead to danger. For example, a personal safety of the vehicle operator may be reduced. In addition, personal safety of other vehicle operators and pedestrians in the vicinity of the vehicle may also be threatened.

One definition of situation awareness includes, "the perception of elements in the environment within a volume of time and space, the comprehension of their meaning, and the projection of their status in the near future." While some definitions are specific to the environment from which they were adapted, the above definition may be applicable across multiple task domains from visual to auditory modalities.

One focus of the present invention is to enhance (i.e., increase) the auditory situation awareness of a vehicle operator and, thereby, improve the personal safety of the vehicle operator, passengers, and other motorists and pedestrians.

Exemplary methods and systems of the present invention are herein disclosed which may address the problem of reduced auditory situation awareness of vehicle operators. In an exemplary method, ambient external sound may be actively reproduced in the vehicle cabin to maintain an approximately constant sound level ratio between internal cabin audio and an external ambient signal level. The external ambient sound may be detected using one or more microphones mounted on, or transducing sound through, the vehicle exterior.

An exemplary system of the present invention may be configured to allow transient ambient sound cues to pass through into the vehicle cabin, providing detectable spatial localization cues for the vehicle operator. Personal safety of the vehicle operator and his/her passengers may therefore be enhanced, which may also increase the safety of other vehicles (such as oncoming emergency vehicles and, other motorists) and pedestrians. The safety benefit may come not only from the enhanced auditory situation awareness, but via reduced driver workload. For example, the system may reduce the burden on the driver to constantly visually scan the environment for emergency vehicles or other dangers that may also recognize acoustical signatures (that may ordinarily be inaudible inside the vehicle cabin).

Referring to FIG. 1, a functional block diagram of an exemplary system (designated generally as system 100) for enhancing auditory situation awareness is shown. System 100 may be placed in vehicle 102. System 100 may include user interface 106, central audio processor system 114 (also referred to herein as processor 114), indicator 116, memory 128 and at least one loudspeaker (for example, right loudspeaker 112 and left loudspeaker 120). System 100 may also include one or more ambient microphones (for example, right microphone 104, front microphone 108, rear microphone 110 and left microphone 122) for capturing ambient sound external to vehicle 102. System 100 may also include at least one internal cabin microphone 118 for capturing sound within vehicle cabin 126.

Processor 114 may be coupled to one or more of user interface 106, indicator 116, loudspeakers 112, 120, memory 128, internal cabin microphone 118 and ambient microphones 104, 108, 110, 122. Processor 114 may be configured to control acquisition of ambient sound signals from ambient microphones 104, 108, 110, 122 and (optionally) a cabin sound signal from internal cabin microphone 118. Processor 114 may be configured analyze ambient and/or cabin sound signals, and to present information by system 100 to vehicle operator 124 (such as via loudspeakers 112, 120 and/or indicator 116) responsive to the analysis. Processor 114 may be configured to control storage of one or more of audio content (AC) signal 107, the ambient sound signals, the cabin sound signal, the analyzed ambient sound signals and the analyzed cabin sound signal. Processor 114 may include, for example, a logic circuit, a digital signal processor or a microprocessor.

In operation, processor 114 may be configured to receive AC signal 107 and reproduce AC signal 107 through loudspeakers 112, 120 into vehicle cabin 126. Processor 114 may also be configured to receive ambient sound signals from respective ambient microphones 104, 108, 110, 122. Processor 114 may also be configured to receive a cabin sound signal from internal cabin microphone 118.

Based on an analysis of the ambient sound signals (and, optionally, the cabin sound signal), processor 114 may mix the ambient sound signal from at least one of ambient microphones 104, 108, 110, 122 with AC signal 107. Processor 114 may also consider operation of other factors that may contribute to sound pressure levels within vehicle cabin 126, described further below with respect to FIG. 3. Processor 114 may also adjust a gain of the ambient sound signal and/or AC signal 107 prior to mixing these signals. The mixed signal may be output to loudspeakers 112, 120. Accordingly, acoustic cues in the ambient signal (such as an ambulance siren, a vocal warning from a pedestrian, a vehicle malfunction sound) may be passed into vehicle cabin 126, thereby providing detectable and spatial localization cues for vehicle operator 124.

AC signal 107 may include any audio signal provided to (and/or generated by) processor 114 that may be reproduced through loudspeakers 112, 120. AC signal 107 may correspond to (without being limited to) at least one of the following exemplary signals: a music or voice audio signal from a music audio source (for example, a radio, a portable media player, a computing device); voice audio (for example, from a telephone, a radio device or an occupant of vehicle 102); or an audio warning signal automatically generated by vehicle 102 (for example, in response to a backup proximity sensor, an unbelted passenger restraint, an engine malfunction condition, or other audio alert signals). AC signal 107 may be manually selected by vehicle operator 124 (for example, with user interface 106), or may be automatically generated by vehicle 102 (for example, by processor 114).

Although in FIG. 1, two loudspeakers 112, 120 are illustrated, system 100 may include more or fewer loudspeakers. For example, system 100 may have more than two loudspeakers for right, left, front and back balance of sound in vehicle cabin 126. As another example, system 100 may include five loudspeakers (and a subwoofer) for 5.1 channel surround sound. It is understood that, in general, system 100 may include one or more loudspeakers.

User interface 106 may include any suitable user interface capable of providing parameters for one or more of processor 114, indicator 116, loudspeakers 112, 120, memory 128, internal cabin microphone 118 and ambient microphones 104, 108, 110, 122. User interface 106 may include, for example, one or more buttons, a pointing device, a keyboard and/or a display device.

Processor 114 may also issue alerts to vehicle operator 124, for example, via indicator 116. Indicator 116 may provide alerts via a visual indication, an auditory indication (such as a tonal alert) and/or a haptic indication. Indicator 116 may include any suitable indicator such as (without being limited to): a display (such as a heads-up display), a loudspeaker or a haptic transducer (for example, mounted in the vehicle's steering wheel or operator seat). According to an exemplary embodiment, a magnitude of the haptic transducer's amplitude, a frequency of its vibration (i.e., higher frequency output connotes higher criticality/urgency) and/or a pulsing of its vibration may be modulated by a degree of criticality/urgency. For example, a higher frequency output may indicate a higher criticality. Similarly, a frequency or a pulsing of a tonal alert may change based on a degree of criticality/urgency. Further, an amplitude, pulsing and/or a frequency of displaying an alert may change in accordance with a degree of criticality/urgency.

In an exemplary embodiment, processor 114 may also use ambient microphones 104, 108, 110, 122 and/or internal cabin microphone 118 and loudspeakers 112, 120 to cancel a background noise component (such as road noise) in vehicle cabin 126. For example, the noise cancellation may be centered at the position of vehicle operator 124.

Memory 128 may store at least one of raw microphone signals (ambient microphones 104, 108, 110, 122 and/or internal cabin microphone 118), analyzed information (from processor 114) or information regarding AC signal 107. Memory 128 may include, for example, a magnetic disk, an optical disk, flash memory or a hard drive.

Ambient microphones 104, 108, 110, 122 may be positioned on vehicle 102 (for example, on an exterior of vehicle 102 or any other suitable location) such that ambient microphones 104, 108, 110, 122 may transduce sound that is external to vehicle 102. Although four ambient microphones 104, 108, 110, 122 are illustrated in FIG. 1, in general, system 100 may include least one ambient sound microphone. Ambient microphones 104, 108, 110, 122 may be configured in their sensitivity and polar directionality, to detect and transduce, in an azimuthal, omnidirectional manner around vehicle 102, ambient sound pressure levels. An ambient sound signal (from one or more of ambient microphones 104, 108, 110, 122) may also be mixed with AC signal 107 before being presented through at least one cabin loudspeaker 112, 120.

According to an exemplary embodiment, processor 114 may estimate a sound pressure level (SPL) of vehicle cabin 126 (referred to herein as the cabin SPL) by analyzing a signal level and signal gain reproduced with at least one of loudspeakers 112, 120, and the sensitivity of respective loudspeakers 112, 120. In another exemplary embodiment, processor 114 may determine the cabin SPL via internal cabin microphone 118. Use of internal cabin microphone 118 may allow consideration of other sound sources in vehicle cabin 126 (i.e., other than sound sources contributed by loudspeakers 112, 120), such as an air conditioning system, and sound from other passengers in vehicle 102.

System 100 may be coupled to a remote location (not shown), for example, by wireless communication. Information collected by system 100 (such as information stored in memory 128) may be provided to the remote location (such as for further analysis).

Figure 2:
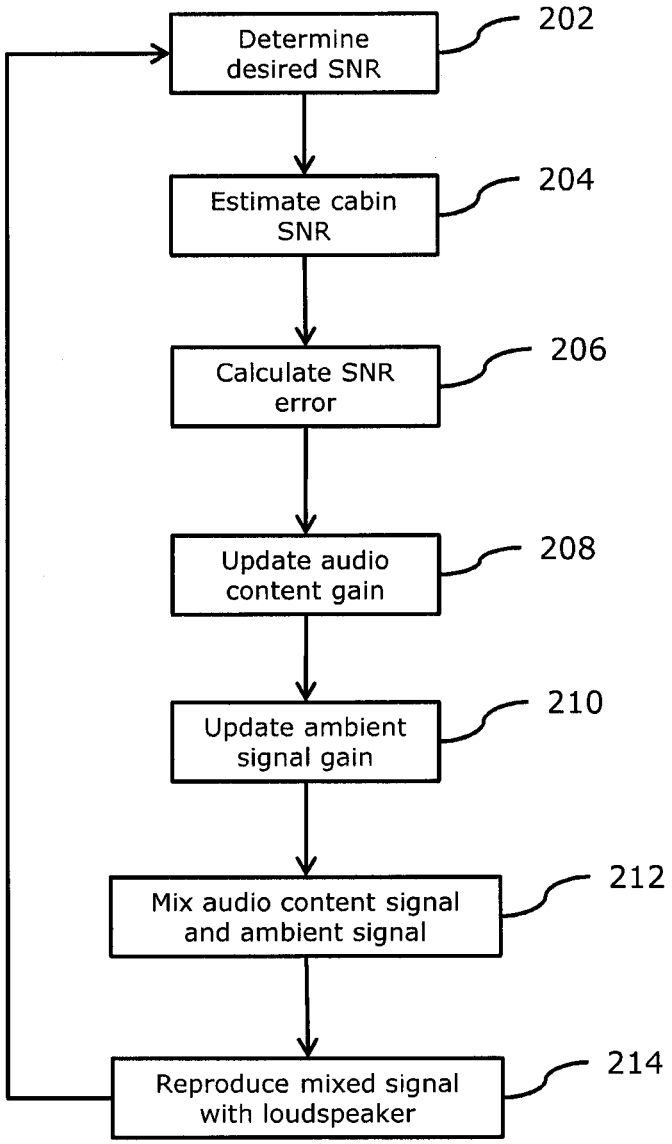
FIG. 2 is a flowchart diagram of an exemplary method for enhancing auditory situation awareness in a vehicle, according to an embodiment of the present invention.

Referring to FIG. 2, a flowchart diagram of an exemplary method for enhancing auditory situation awareness in a vehicle is shown. The steps illustrated in FIG. 2 represent an example embodiment of the present invention. It is understood that certain steps may be performed in an order different from what is shown. It is also understood that certain steps may be eliminated.

At step 202, a desired cabin signal to noise ratio (SNR) may be determined, for example by processor 114 (FIG. 1). The desired SNR may be determined in a number of ways as described further below with respect to FIG. 3.

The desired SNR may be selected based on human factors standards. For example, the International Organization for Standardization (ISO) includes guidelines ISO 7731, which recommends using 13 dB in ⅓ octave bands or 15 dB broadband, rather than have a target SNR as a variable. The SNRs suggested in ISO 7731 are typically for danger signals and may be too high for most vehicle cabin 126 (FIG. 1) situations. According to an exemplary embodiment, a target SNR may include between about +5 to about +10 dB. When background masking exceeds a certain value, e.g. 80 dBA, the target SNR may be reduced so that the system output level does not become objectionable or even hazardous.

At step 204, an actual cabin signal to noise ratio (SNR) 204 may be determined, for example, by processor 114 (FIG. 1). The cabin SNR may be determined in a number of ways as described further below with respect to FIG. 3.

At step 206, a SNR error (or SNR mismatch) 206 may be calculated, for example, by processor 114 (FIG. 1). In an exemplary embodiment, the SNR error may be defined as a difference between the desired SNR (step 202) and the actual SNR (at step 204), where both SNRs may be expressed in decibels (dB).

At step 208 (which may be performed optionally, or in combination with step 210), an Audio Content (AC) gain may be updated, for example, by processor 114 (FIG. 1). The AC gain may be a time-varying gain. In an exemplary embodiment, the AC gain includes a frequency dependent filter. In another exemplary embodiment, the AC gain includes a single time-varying gain coefficient.

At step 210 (which may be performed optionally, or in combination with step 208), at least one Ambient Signal (AS) gain may be updated, for example, by processor 114

(FIG. 1). In an exemplary embodiment, a corresponding AS gain may be included for each of the ambient sound signals from ambient microphones 104, 108, 110, 122. In a further exemplary embodiment, a single AS gain may be applied to a single summed ambient sound signal, where the summed ambient sound signal corresponds to a summation of all ambient sound signals from ambient microphones 104, 108, 110, 122.

The AS gain may include a time-varying gain. In an exemplary embodiment the AS gain includes a frequency dependent filter. In another exemplary embodiment, the AS gain includes a single time-varying gain coefficient (there may be multiple AS gain coefficients for each of the ambient sound signals).

At step 212, the audio content signal 107 (FIG. 1) may be mixed with the ambient sound signal, for example, by processor 114. For example, the AC signal 107 (FIG. 1) (which may be modified with the AC gain (determined in step 208)) and the ambient sound signal (which may be modified with the AS gain determined in step 210), may be summed together. As discussed above, in an exemplary embodiment, a single AS gain may be applied to a summed ambient sound signal (i.e., from the summation of all ambient sound signals). In another exemplary embodiment, a different AS gain may be applied to each of the ambient sound signals.

At step 214, the mixed signal (step 212) may be reproduced, for example, by at least one of loudspeaker 112 or loudspeaker 120. Step 214 may proceed to step 202 and steps 202-214 may be repeated.

In an exemplary embodiment, separate left/right AC gain signals may be used, so that the left channel of AC signal 107 (FIG. 1) is fed to the left loudspeaker 120 in vehicle cabin 126 (and so that the right channel is fed to right loudspeaker 112, and so-on for multichannel audio content signals).

In an exemplary embodiment, the spatial ordering of the ambient sound signals (from ambient microphones 104, 108, 110, 122 as shown in FIG. 1) to vehicle cabin loudspeakers 112, 120 may be preserved. For example, a signal from right ambient microphone 104 may be exclusively reproduced with the right loudspeaker 112; a signal from left ambient microphone 122 may be exclusively reproduced with left loudspeaker 120; and signals from front and rear ambient microphones 108, 110 may be reproduced either with centrally located loudspeakers (for example, a front center loudspeaker), or may be fed equally to right and left loudspeakers 112, 122. The feeding of specific ambient microphone signals to specific vehicle cabin loudspeakers 112, 120 (FIG. 1), and the gain and filtering thereof, may be configured in a manner that facilitates an ability of vehicle operator 124 to localize external sounds in two-dimensional space.

According to another embodiment, ambient sound signals (from ambient microphones 104, 108, 110, 122 as shown in FIG. 1) may be processed (for example by processor 114) to enhance location information provided to vehicle operator 124. For example the ambient sound signals may be processed to determine a spatial location of a siren in a vicinity of vehicle 102 (FIG. 1). The spatial location of the siren may be presented to vehicle operator 124 (FIG. 1) in vehicle cabin 126, by suitable phasing of vehicle cabin loudspeakers 112, 120.

Figure 3:
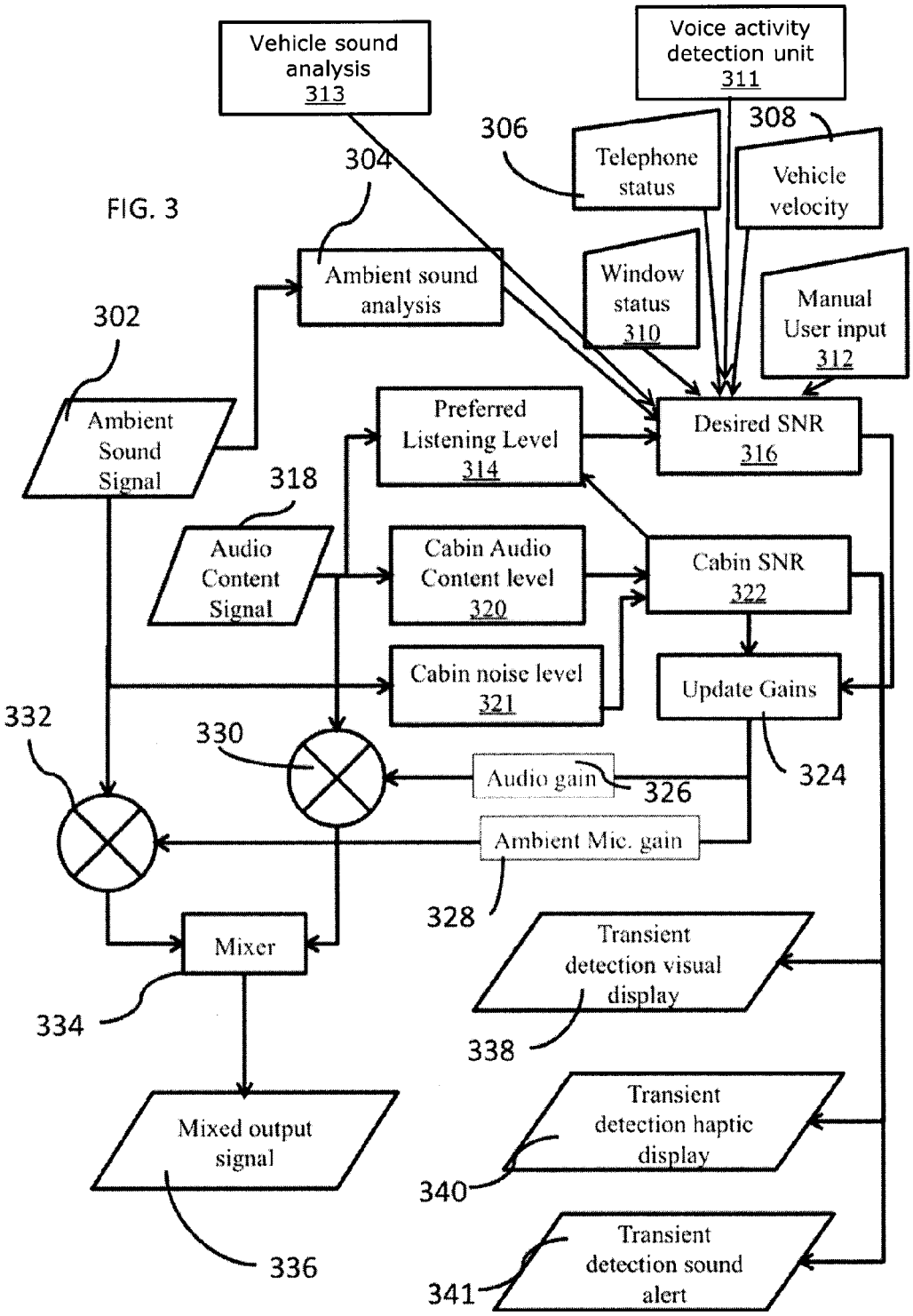
FIG. 3 is a functional block diagram of an exemplary processor of FIG. 1 illustrating an exemplary process for enhancing auditory situation awareness in a vehicle, according to an embodiment of the present invention.

FIG. 3 is a functional block diagram of processor 114 (FIG. 1) illustrating an exemplary process for enhancing auditory situation awareness in vehicle 1.

In an exemplary embodiment, the cabin SNR 322 may be determined as a level ratio (e.g. in dB) between a first "signal" level (cabin audio content level 320) and a second "noise" level (cabin noise level 321). The first "signal" level (cabin audio content 320) corresponds to the sound pressure level or electronic signal level of the audio content signal 318 (e.g., music, speech or an alert audio signal) fed to at least one of loudspeakers 112, 120 (FIG. 1).

In one exemplary embodiment, the second "noise" level (cabin noise level 321) may correspond to the sound pressure level (measured in vehicle cabin 126, such as by internal cabin microphone 118). In another exemplary embodiment, cabin noise level 321 may correspond to an electronic signal level of the sum of the ambient sound signal 302 from the at least one of ambient microphones 104, 108, 110, 122 (FIG. 1) fed to the at least one cabin loudspeaker 112, 120.

In another exemplary embodiment, cabin noise level 321 may correspond to the sound pressure level measured in the vehicle cabin (generated by a sum from among ambient microphones 104, 108, 110, 122 (FIG. 1) fed to at least one loudspeaker 112, 120), combined with the ambient sound signal 302 in vehicle cabin 126 due to passive sound leakage from the vehicle ambient sound field into vehicle cabin 126 (including, for example, engine noise. road noise, and aerodynamic noise generated by vehicle 102).

The passive sound leakage component can be determined by measuring the ambient sound pressure level using at least one of ambient microphones 104, 108, 110, 122 (FIG. 1), and modifying this sound pressure level with a vehicle attenuation function (which may be frequency dependent).

The sound pressure level may be determined by first filtering the ambient sound microphone signal(s) 302 with a frequency dependent filter (e.g., corresponding to the A, B or C weighting curve). Alternatively, the Phon frequency weighting curves may be used, where a particular Phon curve may be selected depending on the un-weighted SPL estimate for each ambient microphone 104, 108, 110, 122 (FIG. 1).

The vehicle attenuation function (i.e., System Transmission Loss (STL)) may be determined using standard acoustic attenuation tests of insertion loss, and depending on the status of the vehicle's total insertion loss (i.e., due to window design, gasketing, structural insulation, etc.), may be further modified. For instance, the degree to which each window is closed may be determined (e.g. as a percentage, where 100% corresponds to the fully closed position for a given window, and 0% corresponds to the fully open position). From this "degree of closure" measure for each window, the vehicle attenuation could be modified, for example, using either a predetermined formula or a look-up (hash) table.

The concept of a "Constant-SNR" system is a slight misnomer, because the system 100 (FIG. 1) may not continually maintain an exactly constant SNR. In an exemplary embodiment, system 100 (FIG. 1) may approximate a "desired" SNR 316. Particularly, it may be desirable to allow the actual cabin SNR 322 to be less than the desired SNR 316, so that sudden external sound onsets are not immediately attenuated. This may allow vehicle operator 124 (FIG. 1) to hear and localize these potentially critical local transient sounds. The automatic detection of transient sounds may be configured by special selection of gain time constants of ambient microphone (mic.) gain 328 that affect ambient sound signal 302. For instance, a slow ambient microphone gain 328 decay may cause the vehicle cabin "noise" level to slowly decrease following a sudden ambient sound event.

Cabin noise level 321 ($L_n$) may be determined in a number of ways. In an exemplary embodiment, cabin noise level 321 may be calculated according to the following formula as:

$$L_n = L_A * STL + L_A * G_{AS}$$
$$= L_A(STL + G_{AS})$$

where $L_A$ represents the ambient sound pressure level (measured at the location of at least one of ambient microphones 104, 108, 110, 122 (FIG. 1) and averaged across all microphones 104, 108, 110, 122, in Pascals), STL represents the Sound Transmission Loss (i.e., vehicle acoustic attenuation), a non-unit scalar value (i.e. linear, not in dB), and $G_{AS}$ represents the ambient microphone gain 328 applied to the ambient sound microphone signal(s) 302 before it is reproduced with at least one loudspeaker 112, 120. For the sake of simplicity, any sensitivity mismatch between microphones 104, 108, 110, 122 (FIG. 1) and loudspeakers 112, 120 may be ignored. In other words, it is assumed that if $G_{AS}$ is unity, the cabin SPL generated by the ambient sound signal 302 is the same as the SPL at the respective ambient microphone 104, 108, 110, 122 (FIG. 1).

The cabin audio content level 320 ($L_s$) may be calculated in a similar manner as:

$$L_s = L_{s_in} * G_s$$

where $L_{s_in}$ is the sound pressure level that would be generated in vehicle cabin 126 (FIG. 1) if the audio content signal 318 were directly reproduced with one or more of the cabin loudspeakers 112, 120, and $G_s$ is the audio gain 326 applied to audio content signal 318.

In an exemplary embodiment, cabin noise level 321 and cabin audio content level 320 may be calculated via frequency weighting and temporal smoothing. For example, by using A-weighting or Phon-weighting, and a leaky-integrator with a time constant of approx. 50-200 ms.

The cabin SNR 322 may therefore be calculated as a log-ratio between the signal level (cabin audio content level 320) and the noise level (cabin noise level 321) as:

$$SNR = \log\frac{L_s}{L_n}$$

Similarly, if the cabin audio content level 320 and cabin noise level 321 is expressed in dB, then the SNR may be calculated as a difference between these levels (i.e. $SNR = L_s - L_n$).

A level of audio content signal 318 and/or cabin SNR 322 may be used to determine a preferred listening level 314 by vehicle operator 124 (FIG. 1) for audio content signal 318. Both the level of audio content signal 318 and cabin SNR 322 (e.g., an amount of noise in vehicle cabin 126) may contribute to preferred listening level 314. Preferred listening level 314 may be determined, for example, over time, based on settings selected by vehicle operator 124 (FIG. 1), for example, via user interface 106.

The desired SNR 316 may be determined using a number of methods (or combinations thereof), for example, by manual user input 312 (e.g., vehicle operator 124 (FIG. 1) may just "dial it in"), automatically by ambient sound analysis 304 and/or vehicle sound generation analysis 313 and/or based on voice activity detection unit 311. Desired SNR 316 may also be determined (without being limited to), for example, based on at least one of telephone status 306, vehicle velocity 308 or window status 310.

Desired SNR 316 may be determined automatically from ambient sound analysis 304 of the ambient sound field. For example, when a predetermined sound is detected such as a siren or car horn, the desired SNR 316 may be decreased to enable the vehicle operator 124 (FIG. 1) to hear the external ambient sound event.

Desired SNR 316 may be determined by analysis of vehicle window position status 310. For example, if the a particular window is at a 50% open location, the desired SNR 316 may be reduced so that lower SPL of external sound signal 302 is reproduced in the vehicle cabin 126 (FIG. 1).

Desired SNR 316 may be determined by consideration of telephone activation status 306 (i.e., whether a telephone is in use). For example, if a telephone is in use, the desired SNR 316 may be reduced so that audio content signal 318 is reduced.

Desired SNR 316 may be determined by analysis of voice activity detection (VAD) unit 311 within vehicle 102 (FIG. 1). For example, if voice activity is detected in the vehicle (using vehicle cabin microphone 118 (FIG. 1)), but not in the incoming audio content signal 318 reproduced within the vehicle cabin 126, then the desired SNR 316 may be set at a first "cabin VAD on" value. Alternatively, if voice activity is not detected originating from the vehicle cabin 126 (FIG. 1), but only on the audio content signal 318, then the desired SNR 316 may be set at a second "audio content VAD on" value; and if voice activity is not detected on either the audio content signal 318 or in the vehicle cabin 126, the desired SNR 316 may be set at a third "VAD off" value.

Desired SNR 316 may be determined by analysis of the vehicle velocity 308 and/or vehicle translational direction, fore-aft. For example, the desired SNR 316 may be different for high versus low speeds. If the velocity is determined to be a backward direction (i.e., the vehicle 102 (FIG. 1) is reversing) then the desired SNR 316 may be increased (to increased situation awareness of the vehicle operator 124), and the rear ambient microphone 110 may be reproduced in the vehicle cabin 126 at a higher level (to increase awareness of objects behind the reversing vehicle 102). Alternatively, if the velocity is zero, the desired SNR 316 may have a predetermined value, which may include different values if the vehicle engine is active or inactive.

Desired SNR 316 may be determined by vehicle sound generation analysis 304. For example, operation of vehicle sound generating devices, such as windshield wipers, a horn, or heating and ventilation systems may increase the cabin noise level 321 and reduce the audibility of audio content signal 318.

Furthermore, it may be desirable to disable the in-cabin ambient sound level calculation (i.e., cabin noise level 321) while the user is talking (i.e. so the vehicle operator's voice level is not factored into the level estimate).

The mismatch between the desired SNR 316 and actual cabin SNR 322 may be used to update 324 the ambient microphone and audio signal gains (i.e. ambient microphone gain 328 and audio gain 326) so as to iteratively force the SNR error (or mismatch) to zero. The audio gain 326 may, optionally, be applied to audio content signal 318 with gain unit 330 and the ambient microphone gain 328 may, optionally, be applied to ambient sound signal 302 with gain unit 332, with the resulting two signals being mixed by summing unit 334, forming mixed output signal 336. If the audio content signal 318 is not modified, then the unmodified signal 318 is summed with the output of ambient sound signal gain unit 332. The resulting mixed output signal 336 is then fed to at least one cabin loudspeaker 112, 120 (FIG. 1).

Various operating modes may be used to control the rate of change of the ambient microphone gain 328 and audio gain 326 (i.e., update gains 324), depending on the degree of signal distortion tolerated or the operator's circumstances. For instance, in a particular "high quality" mode of operation, it may be desirable to only adjust the ambient gain 328, so as to eliminate distortion artifacts from modulating the audio signal level (i.e., to minimize compressive "pumping" artifacts). Alternately, for a "critical mission" scenario, it may be desirable to maintain a high SNR, so that incoming audio messages may be continuously heard.

Depending upon detection of a transient ambient event in cabin SNR, an indication may be provided to vehicle operator 124 (FIG. 1) such as via indicator 116. For example, a transient event detection indication may be provided by at least one of visual display 338, haptic display 340 or sound alert 341.

Figure 4:
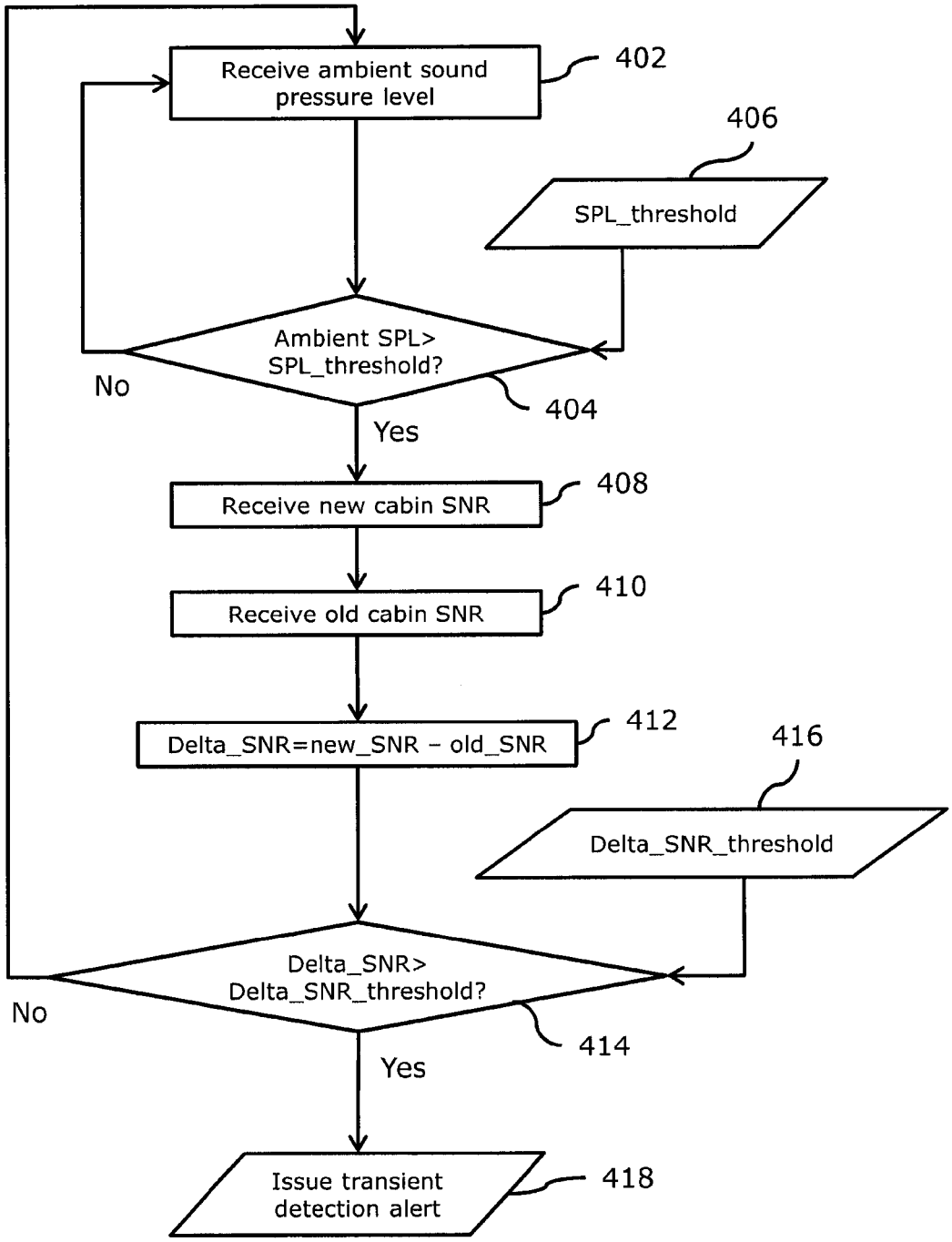
FIG. 4 is a flowchart diagram of an exemplary method for issuing a warning to a vehicle user, according to an embodiment of the present invention.

Referring to FIG. 4, a flowchart diagram of an exemplary method for issuing a transient detection alert to a vehicle operator 124 (FIG. 1) when a transient sound event is detected in a vicinity of vehicle 102 is shown. The exemplary method shown in FIG. 4 may enhance situation awareness of vehicle operator 124 (FIG. 4), especially when they are acoustically detached from the ambient surroundings (e.g. due to acoustic masking or acoustic isolation). The steps illustrated in FIG. 4 represent an example embodiment of the present invention. It is understood that certain steps may be performed in an order different from what is shown. It is also understood that certain steps may be eliminated.

At step 402, an ambient sound pressure level may be received, for example, the sound pressure level may be measured with one or a combination of ambient microphones 104, 108, 110, 122 (FIG. 1) on the vehicle 102. The ambient sound pressure level may be frequency weighted, for example using an A-weighting filter. In an exemplary embodiment, the weighting filter may be selected depending on the un-weighted level estimate (e.g., B or C-weighting for higher SPLs, or un-weighted for very high SPL, e.g., above 85 dB SPL).

At step 404, it is determined whether the received ambient sound pressure level (step 402) is greater than an SPL_threshold value 406, for example, by processor 114 (FIG. 1). In an exemplary embodiment, the SPL_threshold value 406 is equivalent to 60 dB SPL.

If it is determined, at step 404, that the received ambient sound pressure level is less than or equal to SPL_threshold value 406, then step 404 proceeds to step 402 and steps 402 and 404 are repeated.

If it is determined, at step 404, that the received ambient sound pressure level is greater than SPL_threshold value 406, then step 404 proceeds to step 408.

At step 408, a new (i.e., current) cabin SNR estimate is received, for example, as described above with respect to FIG. 3. The a new cabin SNR estimate may be the instantaneous level or may be slowly integrated with a previous old cabin SNR estimate, for example, using a running average estimate. At step 410, an old (i.e., previous) cabin SNR estimate is received (where the old cabin SNR estimate may be the instantaneous level or may be slowly integrated with the previous old cabin SNR estimate using, for example, a running average estimate).

At step 412, a change in the cabin SNR estimate 412, Delta_SNR may be calculated, for example, by processor 114 (FIG. 1). Delta_SNR is equal to the difference of the new cabin SNR (step 408) and the old cabin SNR (step 410) (i.e., Delta_SNR=new_SNR−old_SNR).

At step 414, it is determined whether the calculated change in the cabin SNR estimate (Delta_SNR) (step 412) is greater than Delta_SNR_threshold value 416, for example, by processor 114 (FIG. 1). In an exemplary embodiment, Delta_SNR_threshold value 416 is equal to about 50 dB/second.

If it is determined, at step 414, that the change in the cabin SNR estimate (Delta_SNR) is less than or equal to Delta_SNR_threshold value 416, then step 414 proceeds to step 402 and steps 402-414 are repeated.

If it is determined, at step 414, that the change in the cabin SNR estimate (Delta_SNR) is greater than Delta_SNR_threshold value 416, then step 414 proceeds to step 418.

At step 418, a transient detection alert is issued, for example, via indicator 116 (FIG. 1). The alert may include least one of a haptic alert, a visual alert or an audio alert. It is contemplated that the transient detection alert may also be transmitted (for example, via wireless communication) to a remote location.

A haptic alert to vehicle operator 124 (FIG. 1) may be provided, for example, using a haptic transducer mounted in the vehicle steering wheel or vehicle operator seat. The magnitude of the haptic sensor's amplitude and/or the frequency of its vibration (for example, a higher frequency output may represent a higher criticality/urgency) may be modulated by a degree of mismatch between delta_SNR and delta_SNR_threshold value 416.

A visual alert to vehicle operator 124 (FIG. 1) may be provided, for example, using a heads-up display. A simple tonal alert may be sounded, for example, by one or more of loudspeakers 112, 120, as revealed by a reduction in the determined cabin SNR. The magnitude of the visual and/or audio alert may be modulated by the degree of mismatch between delta_SNR and delta_SNR_threshold value 416.

Although the invention has been described in terms of systems and methods for enhancing situation awareness in a vehicle, it is contemplated that one or more steps and/or components may be implemented in software for use with microprocessors/general purpose computers (not shown). In this embodiment, one or more of the functions of the various components and/or steps described above may be implemented in software that controls a computer. The software may be embodied in non-transitory tangible computer readable media (such as, by way of non-limiting example, a magnetic disk, optical disk, flash memory, hard drive, etc.) for execution by the computer.

Although the invention is illustrated and described herein with reference to specific embodiments, the invention is not intended to be limited to the details shown. Rather, various modifications may be made in the details within the scope and range of equivalents of the claims and without departing from the invention.

What is claimed:

1. An audio system for a vehicle comprising:

at least one ambient microphone, disposed on the vehicle, configured to capture ambient sound external to the vehicle and to produce an ambient sound signal;

a processor configured to receive the ambient sound signal and an audio content signal, the processor configured to mix the ambient sound signal with the audio content signal to generate a mixed output signal;

at least one loudspeaker configured to reproduce the mixed output signal in the vehicle cabin; and wherein the processor is configured to mix the ambient sound signal with the audio content signal based on a difference between a desired signal-to-noise ratio (SNR) in the vehicle cabin and an actual SNR in the vehicle cabin.

2. The audio system according to claim 1, wherein the audio content signal includes at least one of a speech audio signal or a music audio signal.

3. The audio system according to claim 1, wherein the processor is configured to detect a transient acoustic event in the ambient sound signal.

4. The audio system according to claim 1, wherein the processor is configured to detect a transient acoustic event in the ambient sound and further including an indicator for indicating the transient acoustic event in the vehicle cabin, wherein the transient acoustic event comprises one of a siren, a vocal warning, a vehicle malfunction sound, a car horn, or a recognized acoustical signature.

5. The audio system according to claim 1, wherein the processor is configured to detect a transient acoustic event in the ambient sound and further including an indicator for indicating the transient acoustic event to a remote location, wherein the indicator includes at least one of a haptic indicator, a visual indicator, a heads-up display, or an auditory indicator.

6. The audio system according to claim 5, wherein the indicator modifies at least one of an amplitude, a pulsing or a frequency of the indicator in accordance with a criticality of the transient acoustic event.

7. The audio system according to claim 1, wherein the desired SNR is based on at least one of a characteristic of the ambient sound signal, a characteristic of a vehicle sound, detection of voice activity, a window position status, a telephone activation status, a velocity of the vehicle, a vehicle translational direction, a human factors standard, a user indication or a preferred listening level.

8. The audio system according to claim 1, wherein the actual SNR is based on a ratio between a level of the audio content signal and a level of the ambient sound signal.

9. The audio system according to claim 1, further including:

at least one cabin microphone configured to receive interior sound in the vehicle cabin and to produce an interior sound signal, wherein the actual SNR is based on a ratio between a level of the audio content signal and a level of the interior sound signal.

10. A method for increasing auditory situation awareness in a vehicle, the method comprising the steps of:

receiving an ambient sound signal from at least one ambient microphone disposed on the vehicle for capturing ambient sound external to the vehicle;

receiving an audio content signal;

determining a desired signal-to-noise ratio (SNR) in a vehicle cabin of the vehicle;

determining an actual SNR in the vehicle cabin;

determining an SNR error between the desired SNR and the actual SNR;

mixing the audio content signal with the ambient sound signal to generate a mixed output signal responsive to the SNR error; and reproducing the mixed output signal in the vehicle cabin, to increase the auditory situation awareness to the ambient sound external to the vehicle.

11. The method according to claim 10, wherein the mixing of the audio content signal with the ambient sound signal includes updating at least one of an audio content gain of the audio content signal or an ambient signal gain of the ambient sound signal responsive to the SNR error.

12. The method according to claim 10, wherein the audio content signal includes at least a music audio signal.

13. The method according to claim 10, wherein the desired SNR is determined based on at least one of a characteristic of the ambient sound signal, a characteristic of a vehicle sound, detection of voice activity, a window position status, a telephone activation status, a velocity of the vehicle, a vehicle translational direction, a human factors standard, a user indication or a preferred listening level.

14. The method according to claim 10, wherein the determining of the actual SNR includes determining a ratio between a level of the audio content signal and a level of the ambient sound signal.

15. The method according to claim 10, wherein the ambient sound signals are processed to determine a spatial location of an acoustical event and the special location of the acoustical event is represented in the mixed output signal by phasing.

16. The method according to claim 10, the method further including:

receiving an interior sound signal from at least one cabin microphone for receiving interior sound in the vehicle cabin;

wherein the actual SNR is determined from a ratio between a level of the audio content signal and a level of the internal sound signal.

17. The method according to claim 10, the method further including:

detecting a transient acoustic event in the ambient sound signal; and indicating the transient acoustic event in the vehicle cabin or to a remote location.

18. The method according to claim 10, further including detecting a transient acoustic event in the ambient sound and wherein the transient acoustic event is indicated by at least one of a haptic indication, a visual indication or an auditory indication.

19. The method according to claim 10, wherein the mixed output signal is directed to at least one audio signal recording device.

* * * * *